US008833793B2

(12) United States Patent
Fritschi et al.

(10) Patent No.: US 8,833,793 B2
(45) Date of Patent: Sep. 16, 2014

(54) SKIBINDUNG

(75) Inventors: Andreas Fritschi, Thun (CH); Stefan Ibach, Kirchdorf (CH)

(73) Assignee: Fritschi AG-Swiss Bindings, Reichenbach im Kandertal (CH)

( * ) Notice: Subject to any disclaimer, the term of this patent is extended or adjusted under 35 U.S.C. 154(b) by 127 days.

(21) Appl. No.: 13/524,377

(22) Filed: Jun. 15, 2012

(65) Prior Publication Data

US 2013/0334796 A1 Dec. 19, 2013

(51) Int. Cl.
*A63C 9/08* (2012.01)
*A63C 9/02* (2012.01)

(52) U.S. Cl.
CPC .... *A63C 9/02* (2013.01); *A63C 9/08* (2013.01)
USPC ..... 280/614

(58) Field of Classification Search
USPC ..... 280/614
See application file for complete search history.

(56) References Cited

U.S. PATENT DOCUMENTS 7,938,432 B2 * 5/2011 Schlegel et al. ..... 280/601

FOREIGN PATENT DOCUMENTS

| | | | |
|---|---|---|---|
| AT | 378 689 | B | 9/1985 |
| CH | 487 655 | A | 3/1970 |
| CH | 513 659 | A | 10/1971 |
| DE | 2363368 | A1 | 6/1975 |
| DE | 2418577 | A1 | 10/1975 |
| DE | 32 27 237 | C1 | 1/1984 |
| DE | 3542935 | A1 | 7/1986 |
| EP | 0199098 | A2 | 10/1986 |
| EP | 1679099 | B1 | 12/2008 |
| WO | WO 02/089931 | A1 | 11/2002 |

* cited by examiner

*Primary Examiner* — J. Allen Shriver, II
*Assistant Examiner* — Hilary L Johns
(74) *Attorney, Agent, or Firm* — Birch, Stewart, Kolasch & Birch, LLP

(57) ABSTRACT

A ski binding comprises a sole element, a front retaining device, for retaining a toe of the ski boot, and an automatic heel unit, for retaining the heel of the ski boot. The sole element is pivotally mounted and is oriented transverse of the ski. The automatic heel unit allows release in the forward direction. The ski binding has a downhill position, in which the sole element is oriented parallel to the ski, and a climbing positions, in which the sole element can be pivoted. The automatic heel unit, both in the downhill and climbing positions, is arranged on the ski, with the heel region of a ski boot retained in the ski binding. In the climbing position of the ski binding, the heel can be freed, as a result of which the ski boot, can be pivoted about the pivot axis together with the sole element.

20 Claims, 5 Drawing Sheets

SKIBINDUNG

TECHNICAL FIELD

The invention relates to a ski binding for mounting on an upper side of a ski. The ski binding comprises a sole element, a front retaining device, for retaining a ski boot in a toe region of the ski boot, and an automatic heel unit, for retaining the ski boot in a heel region of the ski boot. The sole element is mounted such that it can be pivoted about a pivot axis, which is arranged in the front region of the sole element and is oriented essentially horizontally in the transverse direction of the ski, and the automatic heel unit allows safety release in the forward direction. The ski binding has a downhill position, in which the sole element is oriented essentially parallel to the ski. Furthermore, the ski binding has a climbing position, in which the sole element can be pivoted about the pivot axis.

PRIOR ART

In terms of function, ski bindings can be subdivided into downhill-ski bindings, ski-tour bindings, cross-country bindings and Telemark bindings. Downhill-ski bindings are used only for skiing downhill and skiing on ski lifts, whereas ski-tour bindings, in addition, are also used for walking on skis, in particular for climbing with the aid of climbing skins fastened on the skis, while cross-country bindings are used for cross-country skiing and Telemark bindings are used for skiing using the Telemark technique. Of these ski bindings, downhill-ski bindings have to ensure just that the ski boot is fixed reliably on the ski in a so-called downhill position. In contrast, cross-country bindings and Telemark bindings usually have to retain the ski boot such that it can be pivoted just about an axis oriented in the transverse direction of the ski, whereas ski-tour bindings both have to have a downhill position and have to be able, for climbing purposes, to be moved, in addition, from the downhill position into a climbing position. In such a climbing position, the ski boot, as in the case of cross-country bindings and Telemark bindings, can be pivoted about an axis oriented in the transverse direction of the ski and can be lifted up from the ski in the heel region, as a result of which, for walking purposes, an articulated movement between the ski boot and the ski is made possible.

If, in the case of a cross-country binding and Telemark binding, a downhill position is desired in addition, then, in the case of such a ski binding, as in the case of ski-tour bindings, it is necessary for the ski binding to be capable of being moved both into a downhill position and into a position which corresponds to the climbing position, and in which the ski boot is retained such that it can be pivoted about an axis oriented in the transverse direction of the ski.

Ski-tour bindings, for their part, can be subdivided into two types. The one type comprises a ski-boot carrier, on which the ski boot is retained by binding jaws. In the climbing position here, the ski-boot carrier, with the ski boot retained therein, can be pivoted in relation to the ski. In the downhill position, in contrast, the ski-boot carrier is arrested in a state in which it is oriented essentially parallel to the ski, as a result of which it is also the case that the ski boot retained on the ski-boot carrier is fixed correspondingly on the ski. A representative of this type of ski-tour binding is described, for example, in EP 1 679 099 B1 (Fritschi AG—Swiss Bindings). The second type of ski-tour bindings, in contrast, relies on ski boots with stiff soles. In the case of these ski-tour bindings, the ski boot, in its toe region, is mounted in a pivotable manner in an automatic front unit, which is fixed to the ski. The automatic heel mechanism in this case is likewise fixed to the ski, at a distance from the automatic front mechanism which is adapted to a sole length of the ski boot, and, in the downhill position, it arrests the ski boot in the heel region. In the climbing position, the heel of the ski boot is freed from the automatic heel unit, and therefore the ski boot can be lifted up from the ski and pivoted about the mounting on the automatic front mechanism. A representative of this type of ski-tour binding is described, for example in EP 0 199 098 A2 (Barthel Fritz).

Ski-tour bindings of the first type have the advantage over ski-tour bindings of the second type that, on account of their design alone, they allow relatively high settings for safety release. In addition, they may be of very solid construction, in order also to allow very high settings. Therefore, for example so-called freeride bindings, which do have a walking function, but also allow, at the same time, downhill skiing under extremely hard conditions, belong to the first type of ski-tour binding. Correspondingly, however, ski-tour bindings of the first type, on account of their design principle, also have the disadvantage in relation to ski-tour bindings of the second type that they cannot be of such lightweight construction as ski-tour bindings of the second type. This results in a ski-tour binding of the first type requiring a greater amount of force to be exerted by the skier for climbing purposes than is the case for a ski-tour binding of the second type.

For describing ski-binding systems, a (fictitious) ski is often used as reference system, it being assumed that the binding is mounted on this ski. This custom is adopted in the present text. Therefore, the expression "longitudinal direction of the ski" means along the orientation of the longitudinal axis of the ski. Similarly, "parallel to the ski", for an elongate object, means oriented along the longitudinal axis of the ski. For a planar object, in contrast, the expression "parallel to the ski" means oriented parallel to the sliding surface of the ski. Furthermore, the expression "transverse direction of the ski" is intended to mean a direction transverse to the longitudinal direction of the ski, although it need not necessarily be oriented precisely at right angles to the longitudinal axis of the ski. Its orientation may also deviate somewhat from a right angle. The expression "centre of the ski", in turn, means a centre of the ski as seen in the transverse direction of the ski, while the expression "fixed to the ski" means non-moveable in relation to the ski. In addition, it should be noted that some expressions which do not contain the word "ski" also refer to the reference system of the (fictitious) ski. Therefore, the expressions "front/forward/forwards/forwardly", "rear/rearward/rearwards", "top/above/upward/upwards/upwardly", "downwards/downwardly" and "lateral/laterally" relate to "front/forward/forwards/forwardly", "rear/rearward/rearwards", "top/above/upward/upwards/upwardly", "downwards/downwardly" and "lateral/laterally" of the ski. In the same way, expressions such as "horizontal/horizontally" and "vertical/vertically" refer to the ski, wherein "horizontal/horizontally" means located in a plane parallel to the ski and "vertical/vertically" means oriented perpendicularly to this plane.

A ski-tour binding of the first type introduced above is described in EP 1 679 099 B1 (Fritschi AG—Swiss Bindings). This ski-tour binding comprises an elongate ski-boot carrier, on which are arranged, in a front region, a front jaw and, in a rear region, a heel jaw, for retaining a ski boot. When a ski boot is retained in this ski-tour binding, the toe region of the ski boot is retained by the front jaw and the heel region of the ski boot is retained by the heel jaw. The ski-boot carrier here is located beneath the ski boot, between the ski boot and the ski. In order to allow the walking function, the ski-boot carrier is mounted in its front region such that it can be pivoted about a pivot axis, which is oriented in the transverse direction of the ski. It is thus possible, in the climbing position, for the rear region of the ski-boot carrier, and thus also the heel of the ski boot retained on the ski-boot carrier, to be pivoted away upwards from the ski. In the downhill position, in contrast, the ski-boot carrier is arrested at its rear end, in a state in which it is oriented parallel to the ski, by a holding-down means, as a result of which the ski boot is also fixed on the ski for downhill skiing. In order to ensure the skier's safety, the front jaw allows lateral safety release, whereas the heel jaw allows safety release in the forward direction.

A further ski-tour binding of the first type is described in WO 2011/124785 A1 (Salomon S.A.S). This binding is a freeride binding which is of correspondingly relatively solid construction and therefore allows very high settings for safety release.

These two ski-tour bindings, like all ski-tour bindings of the first type, have the disadvantage that, in comparison with the ski-tour bindings of the second type, they require a greater amount of force to be exerted by the skier for climbing purposes. Understandably, this amount of force exerted increases as the solidity of the binding construction increases. Therefore, this disadvantage is particularly grave in the case of freeride bindings.

DESCRIPTION OF THE INVENTION

It is an object of the invention to provide a ski binding which belongs to the technical field mentioned in the introduction, allows high settings for safety release and, at the same time, requires only a small amount of force to be exerted by the skier for climbing purposes.

The object is achieved as defined by the features of Claim 1. According to the invention, the automatic heel unit, both in the downhill position of the ski binding and in the climbing position of the ski binding, is arranged on the ski. Thereby, the heel region of a ski boot retained in the ski binding, in the downhill position of the ski binding, can be arrested in a lowered position by the automatic heel unit and, in the climbing position of the ski binding, can be freed by the automatic heel unit, as a result of which the ski boot, in the climbing position of the ski binding, can be pivoted about the pivot axis together with the sole element.

The ski binding according to the invention ensures in a known manner the skier's safety during downhill skiing in that the automatic heel unit, as mentioned in the introduction, allows safety release in the forward direction. For this reason, the automatic heel unit then also comprises a safety mechanism, by means of which the ski boot can be released automatically from the automatic heel unit and from the ski binding when the heel of the ski boot is subjected to a force which is directed upwards in relation to the ski and exceeds a release force. This safety mechanism, irrespective of the actual design, has a certain weight, which helps determine the weight of the automatic heel unit. As a result of the invention, it is thus the case that the weight of the automatic heel unit, rather than being lifted upwards from the ski together with the heel of the ski boot by the skier during each climbing step, it remains at a constant height on the ski. Correspondingly, the invention allows the skier to climb with a smaller amount of force being exerted. This advantage applies to all ski bindings according to the invention, irrespective of the actual design of the automatic heel unit. The solution according to the invention is particularly advantageous if the ski binding is designed as a freeride binding and the automatic heel unit is of correspondingly particularly solid and heavy construction.

In order to achieve this advantage of the solution according to the invention, the design of the sole element is immaterial. Therefore, the sole element may have, for example, an elongate plate. Such a plate may be essentially rectangular or also of any other desired shape. In addition, it may also have, if required, for example recesses, in order for the weight of the plate to be reduced. It is also possible, however, for the sole element to comprise one or more rods or tubes of any desired cross section. Irrespective of these options, it is additionally possible for the sole element to comprise a single element or also to be made up of more than one individual part.

According to the invention, the sole element, in the downhill position, is oriented essentially parallel to the ski. It is possible here for the sole element to be prevented from pivoting freely about the pivot axis, for example, by the sole of the ski boot retained in the ski binding. In this case, at least part of the sole element, in the downhill position, should be arranged beneath the boot sole, as a result of which this part of the sole element strikes against the ski boot when the sole element is pushed upwards away from the ski. It is further also possible, however, for the sole element, in the downhill position, to be prevented from pivoting upwards away from the ski by a blocking element. In both variants, it is possible for the sole element, in the downhill position, to be arrested in a fixed state or else to have an amount of bearing play and to be pivotable about the pivot axis only through a small pivot angle, although it always remains oriented essentially parallel to the ski.

Furthermore, in the case of the solution according to the invention, the fact of whether the pivot axis is fixed to the ski or whether the pivot axis is designed such that it can be displaced, for example, in the longitudinal direction of the ski is immaterial. It is possible here for the pivot axis, for example in the climbing position and in the downhill position of the ski binding, to be arranged at different positions as seen in the longitudinal direction of the ski. It is also possible, however, for the pivot axis to be moved in relation to the ski when the sole element is pivoted. Such a movement in relation to the ski can take place, for example, in the longitudinal direction of the ski, vertically in relation to the ski or in any other desired direction. In addition, such a movement can also take place along a curved path.

The pivot axis can be in tangible, axis form irrespective of these variants. However, it may also be in the form of an axis of symmetry, about which the sole element can be pivoted. If the pivot axis, rather than being tangible, is purely an axis of symmetry, then it is possible, for example, for the sole element to be mounted such that it can be pivoted about the pivot axis by a curved slot guide. It is also possible here, as already described, for the pivot axis to be moved in relation to the ski when the sole element is pivoted.

The ski binding is preferably a ski-tour binding. As already explained, the invention in the form of a ski-tour binding has the advantage that it allows the skier to climb with a smaller amount of force being exerted.

As a preferred variant in this respect, the ski binding is a freeride binding. As likewise already explained, the invention in the form of a freeride binding has the advantage that, despite the solid and correspondingly heavy construction which is conventional in the case of freeride bindings, it allows the skier to climb with a smaller amount of force being exerted.

As an alternative to this, however, it is also possible for the ski binding to be a cross-country binding or a Telemark binding, which also has a downhill position and thus allows the skier, if required, to ski downhill, as with a downhill-ski binding.

The sole element preferably extends from the toe region of the ski boot to the heel region of the ski boot. This has the advantage that the sole element extends essentially over the entire length of the sole of the ski boot and can thus interact, for example with the automatic heel unit. This makes it possible, for example in the downhill position, for a force to be transmitted between the automatic heel unit and sole element, as a result of which it is possible to achieve a functionality which is useful for the ski binding. This functionality, in the downhill position, may be, for example, an opening mechanism for the automatic heel unit or a blocking means for the sole element. However, it may also be, for example, a stability-promoting function which is advantageous if use is made of a ski boot with a soft sole.

As a preferred variant in this respect, the sole element extends from the toe region of the ski boot to a centre of the sole of the ski boot. Such a variant has the advantage that the ski binding has less weight, and this makes it easier for the skier to climb with the ski binding.

As an alternative to this, however, it is also possible for the sole element to be of a different length.

The ski binding advantageously comprises a blocking element, by means of which, in the downhill position, the sole element is oriented essentially parallel to the ski and from which the sole element, in the climbing position, can be freed. It is possible here for the sole element, in the downhill position, to be arrested in a fixed state by the blocking element. However, it is also possible for the sole element, in the downhill position, to have an amount of bearing play and to be prevented from moving freely about the pivot axis by the blocking element. In this case, the sole element can be pivoted about the pivot axis, for example, only through a small pivot angle, but it always remains in a state in which it is oriented essentially parallel to the ski, since it is prevented from further pivoting movement by the blocking element. In both cases, the blocking element has the advantage that the ski binding can be moved into the downhill position, for example, without a ski boot retained in the ski binding. It is possible here for the sole element to remain retained in a state, by means of the blocking element, in which it is oriented essentially parallel to the ski. Correspondingly, it is possible for a ski with the ski binding to be transported more easily because the sole element cannot be pivoted freely about the pivot axis.

As an alternative to this, however, it is also possible for the ski binding to have no such blocking element. It is possible here for the sole element, for example in the downhill position, to have at least part of the sole element prevented from pivoting freely about the pivot axis by the sole of the ski boot and to be oriented essentially parallel to the ski. Such an alternative has the advantage that the ski binding can be of more lightweight construction.

If the ski binding has a blocking element, then, in the downhill position, in the case of safety release, the sole element can be retained preferably by the blocking element in the state in which it is oriented essentially parallel to the ski. This safety release may be, for example, safety release in the forward direction by the automatic heel unit. If the automatic heel unit allows lateral safety release, it may also include lateral safety release by the automatic heel unit. If, in contrast, the front retaining device, in addition, allows lateral safety release or safety release in the rearward direction, the safety release may also include corresponding lateral safety release or safety release in the rearward direction by the front retaining device. Irrespective of the type of safety release, this has the advantage that, in the event of a fall, the sole element cannot be pivoted out freely about the pivot axis when the ski boot is released from the ski binding. On the one hand, this prevents the situation where the skier or third parties are put at unnecessary risk by a pivoted-out sole element. On the other hand, however, it also reduces the probability of damage to the ski binding, because the ski cannot collide with something somewhere with the sole element pivoted out freely.

As a preferred variant in this respect, however, it is also possible for the ski binding indeed to have a blocking element, by means of which, in the downhill position, in the case of safety release, the sole element can be retained in a state in which it is oriented essentially parallel to the ski, but one which, in the downhill position, with a ski boot retained in the ski binding, does not interact with the sole element. In this variant, it is possible for the sole element, for example in the downhill position, to have at least part of the sole element prevented from pivoting freely about the pivot axis by the sole of the ski boot and to be oriented essentially parallel to the ski, wherein the blocking element interacts with the sole element only in the event of safety release. Likewise irrespective of the type of safety release, this has the advantage that, in the event of a fall, the sole element cannot be pivoted out freely about the pivot axis when the ski boot is released from the ski binding. Likewise, on the one hand, this prevents the situation where the skier or third parties are put at unnecessary risk by a pivoted-out sole element but, on the other hand, it also reduces the probability of damage to the ski binding, because the ski cannot collide with something somewhere with the sole element pivoted out freely.

In the case of the two preferred variants mentioned above, however, it is also possible, in the case of a certain type of safety release, for the sole element to be retained by the blocking element in a state in which it is oriented essentially parallel to the ski, whereas, in the case of another type of safety release, it cannot be retained by the blocking element in a state in which it is oriented essentially parallel to the ski. If the front retaining device allows safety release, it is possible for example for the sole element, in the case of safety release triggered by the front retaining device, to be retained by the blocking element in a state in which it is oriented essentially parallel to the ski, whereas, in the case of safety release triggered by the automatic heel unit, it is not retained by the blocking element in a state in which it is oriented essentially parallel to the ski. However, it is also possible, quite conversely, for example for the sole element, in the case of safety release triggered by the front retaining device, not to be retained by the blocking element in the state in which it is oriented essentially parallel to the ski, whereas, in the case of safety release triggered by the automatic heel unit, it can be retained by the blocking element in a state in which it is oriented essentially parallel to the ski. Both such variants may be advantageous because, as a result, the design of the ski binding can be simplified and the ski binding can be produced in a correspondingly more cost-effective manner.

As an alternative to these variants, however, it is also possible for the sole element, in the downhill position, in the case of safety release, not to be capable of being retained by the blocking element in a state in which it is oriented essentially parallel to the ski. This may be advantageous, for example, because a more straightforward design of the ski binding is made possible and the ski binding can be produced in a correspondingly more cost-effective manner.

If the ski binding has a blocking element, then the automatic heel unit preferably forms the blocking element. It is possible here, for example, for an element of the automatic heel unit which performs one or more functions relevant to the automatic heel unit also to form, at the same time, the blocking element. This has the advantage that there is no need for any separate blocking element. Correspondingly, it is thus possible for the automatic heel unit to be of more straightforward and cost-effective construction. This straightforward and cost-effective construction is further facilitated if the sole element extends from the toe region of the ski boot to the heel region of the ski boot and, correspondingly, the blocking element formed by the automatic heel unit does not extend far forwards beneath the ski boot. In principle, however, the advantage is also achieved by a sole element which does not extend from the toe region of the ski boot to the heel region of the ski boot and, the automatic heel unit, correspondingly, is lengthened in the forward direction.

As an alternative to this, however, it is also possible for the blocking element to be designed as a separate blocking element. In this case, the blocking element may be mounted, for example, as a separate element in or on the automatic heel unit. It is also possible, however, for the blocking element to be designed as a separate element and be mounted separately. It is possible here for the blocking element to be arranged, for example, in the sole element and, in the downhill position, to block a pivoting movement of the sole element about the pivot axis. For this purpose, it may have, for example, a hook which, in the downhill position, can hook into a counterpart on the automatic heel unit or on the ski in order to retain the sole element in a state in which it is oriented essentially parallel to the ski. With the pivot axis in tangible form, it is thus also possible, however, for the blocking element, in the downhill position, to block, or vastly restrict, rotation of the pivot axis, in order that the sole element is oriented essentially parallel to the ski. It is possible here for the blocking element to be arranged, for example, in the sole element or in an element by means of which the pivot axis is mounted on the ski. It is further also possible, however, for a plurality of such blocking elements to be combined with one another and, in the downhill position, or possibly in the case of safety release, to be able to retain the sole element at the same time in a state in which it is oriented essentially parallel to the ski.

The sole element preferably has arranged on it at least one retaining element, by means of which the ski boot retained in the ski binding, in the climbing position, can be fixed on the sole element. If the sole element here extends from the toe region of the ski boot to the heel region of the ski boot, the at least one retaining element may be positioned on the sole element such that the ski boot can be fixed in the heel region. However, it is also possible, in the case of such a sole element, for the at least one retaining element to be positioned laterally or beneath the sole of the ski boot, in a central region or at the front of the sole element, and to retain the ski boot, in this position, in a fixed state on the sole element. Such an arrangement of the at least one retaining element, however, is also possible, for example, if the sole element extends from the toe region of the ski boot only up to a centre of the ski boot. If the at least one retaining element is positioned laterally, the at least one retaining element can engage around, for example, a sole of the ski boot laterally from the top, in order to fix the ski boot on the sole element. Equally, however, it is also possible for the at least one retaining element to engage, for example, in a counterpart in the sole of the ski boot or in the ski boot, in order to fix the ski boot on the sole element. If the at least one retaining element, in contrast, is arranged beneath the ski-boot sole, it is possible for the at least one retaining element to engage there, for example, in a counterpart in the ski boot, in order to fix the ski boot on the sole element. Irrespective of the positioning of the at least one retaining element on the sole element, the at least one retaining element has the advantage that it is easy to achieve the situation where the sole element, in the climbing position, is lifted upwards from the ski, together with the ski boot, in the heel region of the ski boot, and is pivoted about the pivot axis, during each step taken by the skier.

As an alternative to this however, it is also possible for no retaining means to be arranged on the sole element. In this case it is also possible, for example, for the function of the retaining element, by way of which the sole element, in the climbing position, is lifted upwards from the ski, together with the ski boot, in the heel region of the ski boot, and is pivoted about the pivot axis, during each step taken by the skier, to be ensured by the front retaining device. For this purpose, for example the front retaining device can engage around a sole of the ski boot laterally from above, over a certain region, and thus push the ski boot against the sole element, as a result of which the sole element, in the climbing position, is lifted upwards from the ski, together with the ski boot, in the heel region of the ski boot, and is pivoted about the pivot axis, during each step taken by the skier.

If at least one retaining element is arranged on the sole element, then the ski boot retained in the ski binding, in the downhill position, can advantageously be freed by the at least one retaining element. This has the advantage that, in the downhill position, the automatic heel unit can ensure safety release in the forward direction without this function being impaired by the at least one retaining element.

As a variant to this, however, it is also possible for the retaining element, also in the downhill position, to fix the ski boot on the sole element and to be releasable by safety release of the automatic heel unit. This variant can be realized, for example, in that the at least one retaining element acts as a retaining element for the automatic heel unit. Correspondingly, it is possible for the at least one retaining element, in the downhill position, to interact with the automatic heel unit and to retain the ski boot in the heel region of the ski boot, and, in the case of safety release in the forward direction, to free the heel region of the ski boot. In this example, it is possible for the at least one retaining element, in the climbing position, to be released from the automatic heel unit and to be arranged on the sole element and to fix the ski boot on the sole element, wherein the mechanism for safety release by the automatic heel unit remains on the ski. In a further possible way of realizing this variant, however, it is also possible for the automatic heel unit to have, for example, a dedicated retaining element, wherein, in the downhill position, both the at least one retaining element and the retaining element of the automatic heel unit fix the ski boot on the sole element. It is possible here, in the case of safety release, for the automatic heel unit to interact with the at least one retaining element such that both the retaining element of the automatic heel unit and the at least one retaining element free the heel region of the ski boot.

The automatic heel unit preferably has a downhill configuration and a climbing configuration and, in the downhill position, is located in the downhill configuration and, in the climbing position, is located in the climbing configuration, wherein the heel region of the ski boot retained in the ski binding can be arrested in a lowered position by the automatic heel unit in the downhill configuration and can be freed by the automatic heel unit in the climbing configuration, as a result of which the ski boot, in the climbing position of the ski binding, can be pivoted about the pivot axis together with the sole element. In order to make this possible, the automatic heel unit can be moved back and forth in relation to the ski, for example, between the downhill configuration and the climbing configuration. It is possible here for the movement to be a movement along a linear path, pivoting movement or also a combined movement containing both movement along a linear path and a pivoting movement. It is also possible, however, for the automatic heel unit to be moved back and forth, for example, between the downhill configuration and the climbing configuration by being moved only in relation to itself. This means that for example two parts of the automatic heel unit can be rotated or displaced in relation to one another, although the automatic heel unit remains in the same position in relation to the ski.

As a preferred variant in this respect, it is also possible, however, for the automatic heel unit to have no special downhill configuration or climbing configuration; instead, it is possible for the front retaining device to have a downhill configuration and a climbing configuration and, in the downhill position, to be located in the downhill configuration and, in the climbing position, to be located in the climbing configuration, wherein the toe region of the ski boot can be retained, by the front retaining device, in a rear position in the downhill configuration and in a front position in the climbing configuration. It is thus possible, in the climbing position, for the ski boot to be moved forwards away from the automatic heel unit together with the front retaining device and, correspondingly, not to interact with the automatic heel unit. In addition, it is thus possible, in the downhill position, for the ski boot to be moved rearwards together with the front retaining device, as a result of which the heel region of the ski boot can be arrested in a lowered position by the automatic heel unit. In order to make such a downhill configuration and such a climbing configuration of the front retaining device possible, for example the front retaining device may be designed such that it can be displaced in the longitudinal direction of the ski. If it is the case here that the front retaining device is arranged on the sole element, then it is possible, for this purpose, for the front retaining device to be designed such that it can be displaced in relation to the sole element or for the sole element to be designed such that it can be displaced in the longitudinal direction of the ski. In the latter case, it is also possible, for example, for the pivot axis to be displaceable from the rear in the downhill position to the front in the climbing position, and back. In order to make this possible, the pivot axis may be mounted such that it can be displaced in the longitudinal direction of the ski, for example, in relation to a front base element, which can be fastened on the ski. All the embodiments in which the front retaining device has a downhill configuration and a climbing configuration and, in the downhill position, is located in the downhill configuration and, in the climbing position, is located in the climbing configuration have the advantage that the automatic heel unit, can be located in the same position in relation to the ski both for downhill action and for climbing action. This allows the automatic heel unit to be of more straightforward construction and, nevertheless, to have the necessary stability.

If the automatic heel unit has a downhill configuration and a climbing configuration, then the automatic heel unit is mounted preferably in a moveable manner on a base element, which is fixed to the ski, and can be moved in relation to the base element into the downhill configuration and into the climbing configuration. It is possible here for the automatic heel unit to be mounted on the base element directly or else via one or more intermediate elements. Irrespective of possible intermediate elements, the mounting of the automatic heel unit on the base element, which is fixed to the ski, has the advantage that stable mounting of the automatic heel unit on the base element, and thus on the ski, is made possible.

If the automatic heel unit is mounted in a moveable manner on a base element, which is fixed to the ski, the automatic heel unit is mounted on the base element such that it can be displaced preferably in the longitudinal direction of the ski, and it is located in a front position in the downhill configuration and in a rear position in the climbing configuration. It is possible here for the automatic heel unit to be mounted on the base element, for example, by a slot guide and a sliding block, by a rail and a carriage, by a rail and rollers or in some other manner. The important factor here is that the automatic heel unit, in the downhill configuration, is located in a position which is further forwards on the ski than its position in the climbing configuration. This achieves the advantage that the automatic heel unit, in the climbing configuration, has been moved away from the ski boot in the rearward direction and cannot interact with the heel region of the ski boot, whereas the automatic heel unit, in the downhill configuration, is located further forwards and can interact with the heel region of the ski boot and arrest the ski boot in a lowered position. Furthermore, such an embodiment has the advantage that linear guidance can ensure stable mounting of the automatic heel unit on the base element.

In an advantageous variant in this respect, however, it is also possible for the automatic heel unit to be mounted on the base element such that it can be displaced in the transverse direction of the ski or at an angle to the longitudinal direction of the ski. In this case, the automatic heel unit is located in a first position in the downhill configuration and in a second position in the climbing configuration. It is also possible here for the automatic heel unit to be designed in two parts and for a first part of the automatic heel unit to be mounted on the base element such that it can be displaced in a first direction, essentially transversely to the ski, and for a second part of the automatic heel unit to be mounted on the base element such that it can be displaced in a second direction, essentially transversely to the ski. It is possible here, for example, for both parts of the automatic heel unit to be moved away laterally in order to free the heel region of the ski boot in the climbing position. This variant likewise achieves the advantage for linear guidance being able to ensure stable mounting of the automatic heel unit on the base element.

If the automatic heel unit is mounted in a moveable manner on a base element, which is fixed to the ski, the automatic heel unit, in a further preferred variant, is mounted on the base element such that it can be pivoted about an axis, and is located in a first position in the downhill configuration and in a second position in the climbing configuration. This has the advantage that it is easy to achieve the situation where the automatic heel unit, in the downhill position, can interact with the heel region of the ski boot and, in the climbing position, the heel region of the ski boot is freed by the automatic heel unit. It is likewise possible here for the automatic heel unit to be designed in two parts and for a first part of the automatic heel unit to be mounted on the base element such that it can be pivoted in a first direction, essentially transversely to the ski, and for a second part of the automatic heel unit to be mounted on the base element such that it can be pivoted in a second direction, essentially transversely to the ski. It is thus possible, for example, for both parts of the automatic heel unit to be moved away laterally in order to free the heel region of the ski boot in the climbing position.

In a further preferred variant in this respect, the automatic heel unit is mounted on the base element such that it can be pivoted about an axis and can be displaced along a linear path. It is possible here for the axis to be moveable along the linear path together with the automatic heel unit or for the axis to be fixed to the ski, wherein the automatic heel unit is designed such that it can be moved along the linear path in relation to the axis. It is further possible for the automatic heel unit to be designed in two parts and for a first part of the automatic heel unit to be mounted on the base element such that it can be pivoted in a first direction, essentially transversely to the ski, and such that it can be displaced along a first linear path and for a second part of the automatic heel unit to be mounted on the base element such that it can be pivoted in a second direction, essentially transversely to the ski, and such that it can be displaced along a second linear path. It is possible here for the first and the second linear paths to be identical or different. In both cases, the two parts of the automatic heel unit can be moved away laterally in order to free the heel region of the ski boot in the climbing position.

As an alternative to this, however, it is also possible for the automatic heel unit to have no special downhill configuration and no special climbing configuration and, both in the downhill position and in the climbing position, to be located in the same configuration. In this case, however, the automatic heel unit, in this same configuration, should allow safety release in the forward direction when the ski boot, in the downhill configuration, is arrested in a lowered position by the automatic heel unit.

Advantageously, the front retaining device can be moved in the longitudinal direction of the ski, and is located at the rear in the downhill position and at the front in the climbing position. This has the advantage that, as a result, the ski boot retained in the ski binding, together with the front retaining device, can be moved to the rear in the downhill position and to the front in the climbing position. Correspondingly, it is possible for the ski boot, in the climbing position, to be moved away from the automatic heel unit in the forward direction and thus to be freed from the automatic heel unit, as a result of which the ski boot can be pivoted about the pivot axis together with the sole element. In addition, it is thus possible for the ski boot, in the downhill position, to be moved rearwards together with the front retaining device, as a result of which the automatic heel unit can interact with the heel region of the ski boot and can arrest the ski boot in a lowered position. This allows the automatic heel unit to remain in the same position both for downhill action and for climbing action and thus to be of more straightforward design.

As a preferred variant in this respect, however, it is also possible for the front retaining device, in the climbing position, to be moveable in the longitudinal direction of the ski and, in the downhill position, to be located further rearwards in relation to the positions which are possible for climbing action. On the one hand, this achieves the advantage that the front retaining device, in the climbing position, allows movement in relation to the ski which corresponds to a natural walking movement of the skier. On the other hand, however, it also has the advantage that, as a result, the ski boot retained in the ski binding, together with the front retaining device, can be moved to the rear in the downhill position and to the front in the climbing position. Correspondingly, it is possible for the ski boot, in the climbing position, to be moved away from the automatic heel unit in the forward direction and thus to be freed from the automatic heel unit, as a result of which the ski boot can be pivoted about the pivot axis together with the sole element. In addition, it is thus possible for the ski boot, in the downhill position, to be moved rearwards together with the front retaining device, as a result of which the automatic heel unit can interact with the heel region of the ski boot and can arrest the ski boot in a lowered position. This makes it possible for the automatic heel unit to remain in the same position both for downhill action and for climbing action and thus to be of more straightforward design.

As an alternative to this, however, it is also possible for the front retaining device to be located in the same position both for downhill action and for climbing action when the sole element, for climbing action, is oriented essentially parallel to the ski. It is possible here for the front retaining device, for example in the climbing position, during a movement of the sole element about the pivot axis, likewise to be pivotable about the pivot axis or else to be fixed in relation to the pivot axis.

Preferably the pivot axis, about which the sole element can be pivoted, can be moved in the longitudinal direction of the ski, and is located at the rear in the downhill position and at the front in the climbing position. This has the advantage that, as a result of the pivot axis being moved in the longitudinal direction of the ski, for example also the sole element or the front retaining device, or both the sole element and the front retaining device, can also be moved in the longitudinal direction of the ski. If the sole element can be moved together with the pivot axis, then it is thus possible, for example, for the sole element, in the downhill position, to be retained essentially parallel to the ski by a blocking element and, in the climbing position, to be freed from the blocking element by being moved away from the blocking element in the forward direction. If, in contrast, the front retaining device can be moved together with the pivot axis, then it is thus possible, for example, for the ski boot retained in the ski binding, together with the front retaining device, to be moved to the rear in the downhill position and to the front in the climbing position. Correspondingly, it is thus possible for the ski boot, in the climbing position, to be moved away from the automatic heel unit in the forward direction and thus to be freed from the automatic heel unit, as a result of which the ski boot can be pivoted about the pivot axis together with the sole element. In addition, it is thus possible for the ski boot, in the downhill position, to be moved rearward together with the front retaining device, as a result of which the automatic heel unit can interact with the heel region of the ski boot and can arrest the ski boot in a lowered position. This makes it possible for the automatic heel unit to remain in the same position both for downhill action and for climbing action and thus to be of more straightforward design.

As an alternative to this, however, it is also possible for the pivot axis to be moveable in the longitudinal direction of the ski just in the climbing position, when the sole plate is pivoted about the pivot axis, or else it is also possible for the pivot axis not to be moveable in the longitudinal direction of the ski at all.

Preferably, the sole element can be moved in the longitudinal direction of the ski, and is located at the rear in the downhill position and at the front in the climbing position. Depending on the embodiment, this has various advantages. In an embodiment with a blocking element, the moveable sole element, for example, has the advantage that the sole element, in the downhill position, can be retained essentially parallel to the ski by a blocking element and, in the climbing position, can be released from the blocking element by being moved away from the blocking element in the forward direction. In an embodiment in which the automatic heel unit has a climbing configuration and a downhill configuration and the sole element extends rearwards to the automatic heel unit, the moveable sole element, in contrast, has, for example, the advantage that movement of the sole element allows the automatic heel unit to be shifted between the climbing configuration and the downhill configuration. Correspondingly, it is thus made possible for the ski binding to be shifted between the climbing position and the downhill position by actuation in the region of the front retaining device. In contrast, in an embodiment with a front retaining device arranged on the sole element, the moveable sole element has, for example, the advantage that the front retaining device may be designed such that it can be displaced together with the sole element. It is thus possible for the ski boot retained in the ski binding, together with the front retaining device, to be moveable to the rear in the downhill position and to the front in the climbing position. Correspondingly, the ski boot, in the climbing position, can be moved away from the automatic heel unit in the forward direction and can thus be freed from the automatic heel unit, as a result of which the ski boot can be pivoted about the pivot axis together with the sole element. In addition, it is thus possible for the ski boot, in the downhill position, to be moved rearwards together with the front retaining device, as a result of which the automatic heel unit can interact with the heel region of the ski boot and can arrest the ski boot in a lowered position. This makes it possible for the automatic heel unit to remain in the same position both for downhill action and for climbing action and thus to be of more straightforward design.

As an alternative to this, however, it is also possible for the sole element not to be moveable in the longitudinal direction of the ski. Such an alternative has the advantage that the sole element can be of more straightforward design.

Preferably, the automatic heel unit, in the downhill position, can be moved in relation to the ski along a dynamic path essentially in the longitudinal direction of the ski. It is thus possible to compensate for a change in the distance which can arise between the front jaw and the automatic heel unit when the ski flexes during skiing. Correspondingly, the ski is not stiffened by the ski binding and maintains its bending properties. The ability of the automatic heel unit to move along the dynamic path thus has the advantage that the skier's skiing comfort is increased.

As an alternative to this, however, it is also possible for the automatic heel unit, in the downhill position, not to be moveable along a dynamic path.

If the automatic heel unit, in the downhill position, can be moved in relation to the ski along a dynamic path essentially in the longitudinal direction of the ski, then the automatic heel unit, in the downhill position, is advantageously subjected to a forwardly directed force by an elastic element. This has the advantage that the automatic heel unit is always pushed against the heel region of the ski boot by the forwardly directed force and is positioned along the dynamic path in accordance with the state of bending of the ski, as a result of which the ski boot remains retained between the front jaw and the automatic heel unit even in the case of the state of bending of the ski changing.

As an alternative to this, however, it is also possible for the automatic heel unit, in the downhill position, to retain the heel region of the ski boot such that the automatic heel unit, rather than being capable of being released from the ski boot in the rearward direction by movement relative to the ski boot, is positioned along the dynamic path in accordance with the state of bending of the ski. For this purpose, the automatic heel unit can retain the heel region of the ski boot, for example, by means of one or more hooks or by means of a clamping device. However, it is also possible, for example, for the heel region of the ski boot and the automatic heel unit each to comprise, for this purpose, an element which magnetically attract one another.

Further advantageous embodiments and combinations of features of the invention can be gathered from the following detailed description and from the patent claims as a whole.

BRIEF DESCRIPTION OF THE DRAWINGS

In the drawings used to explain the exemplary embodiment.

In principle, like parts are provided with like designations in the figures.

WAYS OF IMPLEMENTING THE INVENTION

Figure 1:
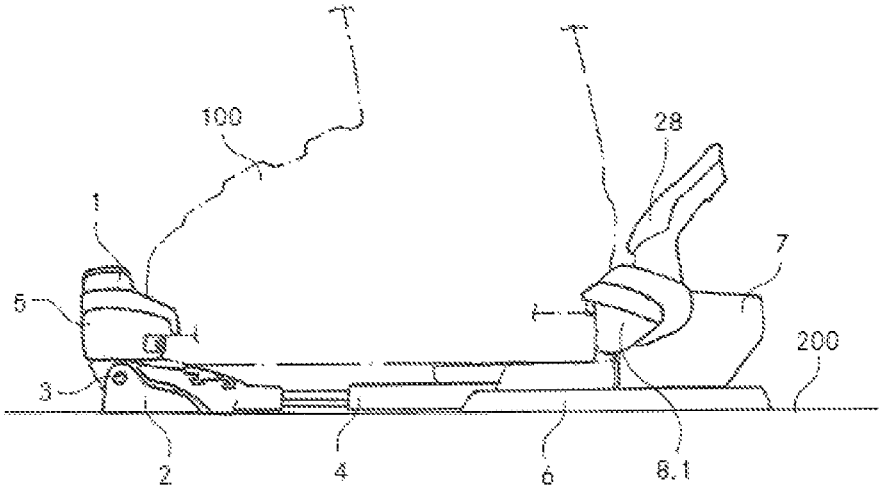
FIG. 1 shows a schematic side view of a ski binding according to the invention in a downhill position.

FIG. 1 shows a schematic side view of a ski binding 1 according to the invention in a downhill position with a ski boot 100 retained in the ski binding 1. This ski binding 1 is fastened on a ski 200, of which only a single surface is however illustrated, as a horizontal line, in the illustration shown. This surface of the ski 200 defines a ski-parallel plane, which intersects the plane of the illustration along the horizontal line shown and which extends out of the plane of the illustration perpendicularly to the plane of the illustration. Correspondingly, the top and bottom of the illustration are also the top and bottom of the ski binding 1. Furthermore, the left-hand side of the illustration corresponds to the front of the ski binding 1, whereas the right-hand side of the illustration corresponds to the rear of the ski binding 1.

The ski binding 1 comprises a front base element 2, which is fastened on the ski 200 and in which is mounted a pivot axis 3, which is oriented horizontally in the transverse direction of the ski. The ski binding 1 also comprises a sole plate 4, which is mounted in its front region such that it can be pivoted about the pivot axis 3. This sole plate 4 has fastened on it, above the pivot axis 3, a front jaw 5, which retains the ski boot 100 in a toe region of the ski boot 100 by engaging around a sole of the ski boot 100 at the front from the top. The sole plate 4 here is located beneath the sole of the ski boot 100 and extends rearwards from the front jaw 5 to a heel region of the ski boot 100.

The ski binding 1 also comprises a rear base element 6, which, like the front base element 2, is fastened on the ski 200. However, this rear base element 6 is arranged further to the rear of the ski 200 than the front base element 2 and is positioned on the ski 200 such that a front region of the rear base element 6 is located beneath a rear region of the sole plate 4 when the sole plate 4, as shown here in FIG. 1, is oriented essentially parallel to the ski. A rear region of the rear base element 6 is thus located behind a rear end of the sole plate 4. An automatic heel unit 7 is mounted on this rear region of the base element 6 such that it can be moved in the longitudinal direction of the ski. In the illustration which is shown in FIG. 1, this automatic heel unit 7 is located in a downhill configuration. This means that the automatic heel unit 7 is located in a position in which it engages around the heel region of the ski boot 100 from the top and thus retains the ski boot 100 in a state in which it is arrested in a lowered position. If, in this position, the ski boot 100 is subjected to a forwardly or upwardly directed force which exceeds a minimal force, then the heel region of the ski boot 100 is released from the automatic heel unit 7 by safety release in the forward direction. For this purpose, the automatic heel unit 7 comprises a safety-release mechanism which is generally conventional in ski bindings.

In order to make it easy for the skier to step into the ski binding 1, and step out of the same, in the downhill position, the automatic heel unit 7 comprises a step-in mechanism which is generally known for downhill-ski bindings: following safety release in the forward direction, or once the skier has stepped out normally, the automatic heel unit 7 is located in an open position. In this open position, an element of the automatic heel unit 7 which, in the downhill position, interacts with the heel region of the ski boot 100 has been pivoted upwards. This upwardly pivoted element has, in its lower region, a tread spur, which is pushed downwards by the ski boot 100 when the skier steps into the ski binding 1. The element thus snaps downwards and retains the ski boot 100 in a fixed state between the front jaw 5 and the automatic heel unit 7. This snapping action of the element is accompanied by an obliquely rearwardly and upwardly oriented opening lever 28 on the automatic heel unit 7 snapping some way further upwards. In order to step out of the ski binding 1, the skier just needs to push the opening lever 28 downwards, as a result of which the element interacting with the heel region of the ski boot 100 snaps upwards again and frees the ski boot 100. Similarly, this element snaps upwards during safety release in the forward direction, whereas the opening lever is moved downwards by the upward snapping action.

In the downhill position of the ski binding 1 which is shown in FIG. 1, the automatic heel unit 7, as is known for downhill-ski bindings, has been subjected to a forwardly acting spring force, which pushes the automatic heel unit 7 forwards against a front stop on the rear base element 6. The front stop here is positioned such that the automatic heel unit 7 can interact precisely with the heel region of the ski boot 100. Starting from this position, the automatic heel unit 7 can be pushed rearwards counter to the spring force. This makes it possible for the automatic heel unit 7 to be pushed rearwards from the ski boot 100 or the sole plate 4 when the ski 200, during skiing, is flexed downwards in the region of the ski binding and the sole plate 4 and the heel region of the ski boot 100 are moved rearwards relative to the rear base element 6 on account of the curvature of the ski 200. Correspondingly, the ski binding 1 does not give rise to any significant stiffening of the ski 200 in the central region of the ski 200, and this ensures optimum skiing comfort for the skier.

Figure 2:
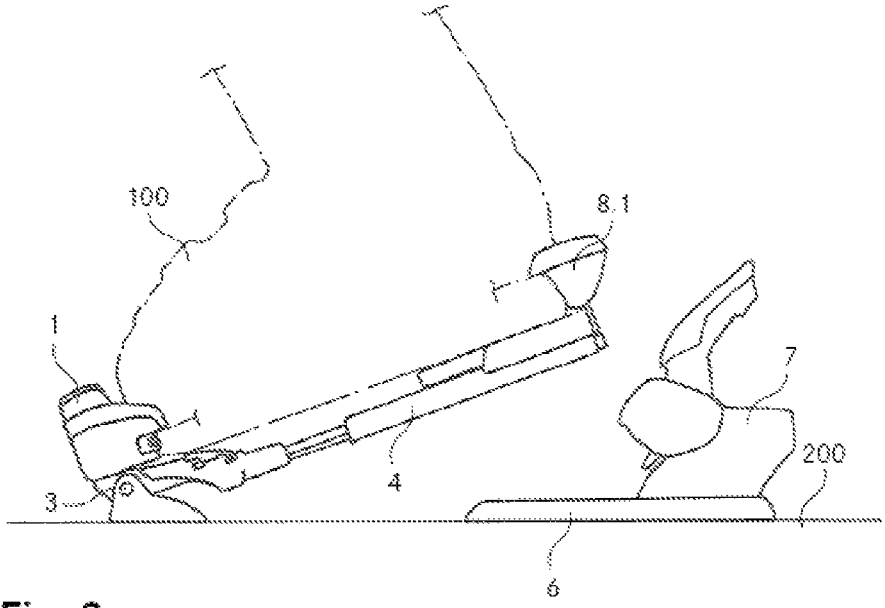
FIG. 2 shows a schematic side view of the ski binding according to the invention in a climbing position.

FIG. 2 shows, like FIG. 1 before it, a schematic side view of the ski binding 1 according to the invention with the ski boot 100 retained in the ski binding 1. In contrast to the illustration in FIG. 1, the ski binding 1 in the illustration in FIG. 2, rather than being located in the downhill position, is located in a climbing position. Therefore, the automatic heel unit 7 has been displaced rearwards in relation to FIG. 1. In this position, the automatic heel unit 7 has been moved rearwards in relation to the heel region of the ski boot 100 and in relation to the rear end of the sole plate 4, as a result of which the heel region of the ski boot 100 and the rear end of the sole plate 4 are freed from the automatic heel unit 7. This makes it possible for the sole plate 4 to be pivoted about the pivot axis 3, through up to 90°, together with the ski boot 100, as a result of which the skier is offered a natural walking movement. Therefore, this positioning of the automatic heel unit 7 is also referred to here as a climbing configuration.

In order that, in the climbing position of the ski binding 1, the skier does not simply lift up the ski boot 100 from the sole plate 4, and thus from the ski binding 1, during walking, the sole of the ski boot 100 is fixed on the sole plate 4 by two retaining elements 8.1 in the heel region of the ski boot 100. For this purpose, the two retaining elements 8.1 are mounted in the rear region of the sole plate 4 (see FIG. 4), each on one side of the sole plate 4, such that they can be pivoted about an axis 20 oriented horizontally in the transverse direction of the ski, and they have their upper regions pivoted forwards, as a result of which their upper regions engage around the sole of the ski boot 100 at the rear from the top. As can be seen in FIG. 1, the two retaining elements 8.1, in contrast, in the downhill position, have their upper regions pivoted rearwards, as a result of which they free the heel region of the ski boot 100 in order that the ski boot 100 can be released from the ski binding 1 in the case of safety release in the forward direction by the automatic heel unit 7.

This pivotability of the two retaining elements 8.1 also makes it easy for the skier to step into the ski binding 1, and step out of the same, in the climbing position. For this purpose, the two retaining elements 8.1 are subjected, by leg springs (not shown), to a torque which pushes the upper regions of the retaining elements 8.1 forwards. In order for the skier to step into the ski binding 1, the ski boot 100 first of all is inserted into the front jaw 5 and then has the heel region lowered onto the retaining elements 8.1. Since the front, upper regions of the two retaining elements 8.1 are bevelled in the forward direction, the upper regions of the two retaining elements 8.1 here are pushed rearwards, counter to the torque, by the rear edge of the ski-boot sole. As soon as the ski boot 100 has been lowered onto the sole plate 4, the retaining elements 8.1 can be moved back by the torque and engage around the heel of the ski boot 100 at the rear from the top, as a result of which the ski boot 100 is fixed on the sole plate 4. In order for the skier to step out of the ski binding 1 again, all that is required is for the rear, upper region of one of the two retaining elements 8.1 to be pushed downwards. Since the two retaining elements 8.1 are connected to one another by a connecting bar 19 (see FIGS. 3 and 4), the upper regions of the two retaining elements 8.1 are thus pivoted rearwards counter to the torque and the heel region of the ski boot 100 is freed. Correspondingly, the ski boot 100 can thus be lifted out of the ski binding 1.

Figure 3:
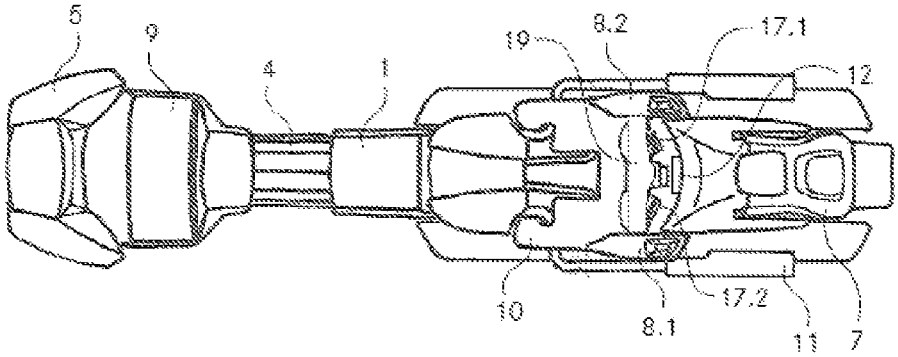
FIG. 3 shows a schematic plan-view illustration of the ski binding according to the invention in the climbing position.

FIG. 3 shows a further schematic illustration of the ski binding 1 according to the invention in the climbing position. In contrast to FIG. 2, however, the ski boot 100 is not shown and the sole plate 4 has been lowered in the direction of the ski. In addition, the ski binding 1 is shown from above. As in FIG. 2, however, the left-hand side of the illustration corresponds to the front of the ski binding 1 and the right-hand side of the illustration corresponds to the rear of the ski binding 1. Therefore, in FIG. 3, the front jaw 5 of the ski binding 1 is located on the left-hand side and the automatic heel unit 7 of the ski binding 1 is located on the right-hand side. The sole plate 4 is located therebetween, and comprises in its front region, in the vicinity of the front jaw 5, a sliding plate 9 for supporting a ski boot retained in the ski binding 1. If the front jaw 5 allows lateral safety release, then this sliding plate 9 not only supports the ski boot, but also facilitates a sliding movement of the ski boot in the lateral direction. The sole plate 4 also has, in its rear region, a supporting surface 10 for supporting a ski boot retained in the ski binding 1. A ski brake 11, which is generally known for ski bindings, is arranged on this supporting surface 10. This ski brake 11 is deactivated when a ski boot is retained in the ski binding 1, and is activated by a known mechanism as soon as the ski boot is removed from the ski binding 1.

It can also be seen in the plan view of the ski binding 1 which is shown in FIG. 3 that the two retaining elements 8.1, 8.2, which are arranged in the rear region of the sole plate 4, are spaced apart from one another to the extent where the automatic heel unit 7 is located between the two retaining elements 8.1, 8.2 and, in the downhill position, can be moved forwards between the two retaining elements 8.1, 8.2. A blocking element 12, which is arranged in the front, lower region of the automatic heel unit 7 is thus moved forwards and engages around the rear end of the sole plate 4 from the top rear. The sole plate 4 is thus retained, in the downhill position, in a state in which it is oriented essentially parallel to the ski.

Figure 4:
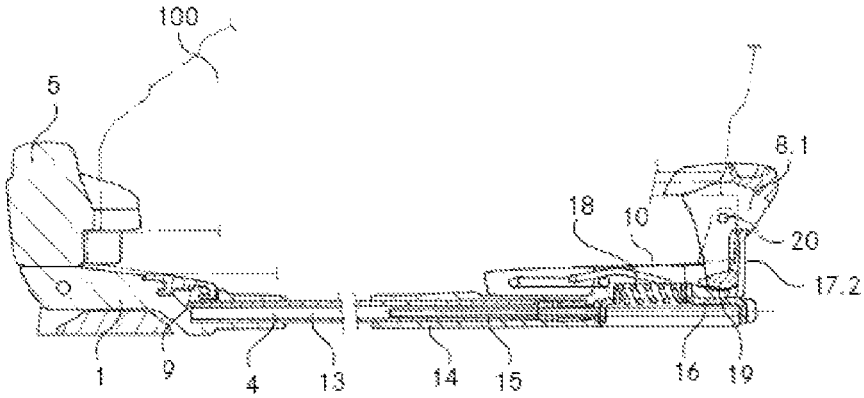
FIG. 4 shows a vertically oriented section, running in the longitudinal direction of the ski, through the ski binding according to the invention in the climbing position, without an automatic heel unit, FIGS. 5*a, b* and *c* each show a simplified, schematic illustration of a rear base element with an automatic heel unit and heel element, FIGS. 6*a, b* and *c* each show a simplified, schematic illustration of the automatic heel unit with a blocking element, and FIGS. 7*a, b* and *c* each show a simplified, schematic illustration of the automatic heel unit on the rear base element with an adjusting lever for adjusting the automatic heel unit from a downhill configuration into a climbing configuration and back.

FIG. 4 shows a vertically oriented section, running in the longitudinal direction of the ski, through the ski binding 1 in the climbing position, without the automatic heel unit 7, but with the ski boot 100 retained in the ski binding 1. As is already the case in FIG. 3, the left-hand side of the illustration here corresponds to the front of the ski binding 1, whereas the right-hand side of the illustration corresponds to the rear of the ski binding 1. The sectional illustration makes it possible to see the construction of the sole plate 4 with the retaining elements 8.1, which are arranged in the rear region of the sole plate 4 and which can be pivoted about the axis 20. It can thus be seen that the sole plate 4 has a linkage 13, which extends rearwards from a front region of the sole plate 4 with the front jaw 5 and the sliding plate 9 to a rear region of the sole plate 4. A heel element 14 is mounted at the rear end of this linkage 13, the heel element forming the supporting surface 10 for the heel of the ski boot 100 and having the two retaining elements 8.1 mounted on it such that they can be pivoted about the axis 20.

For being possible to adapt the length of the sole plate 4 and of the ski binding 1 as a whole to ski boots of different sizes, the heel element 14 is mounted such that it can be displaced in the longitudinal direction of the linkage 13 in relation to the linkage 13. Thereby, it is possible to control the position of the heel element 14 in relation to the linkage 13 by means of a screw 15, which is screwed into the linkage 13 from the rear. A sheet-metal element 16 is mounted on the screw 15 for this purpose. Turning the screw 15 in relation to the linkage 13 causes this screw 15 to be moved forwards or rearwards together with the sheet-metal element 16, as a result of which the heel element 14, which is mounted on the sheet-metal element 16, is also moved along. In order to make this functionality possible, the sheet-metal element 16 has in each case a front and a rear, vertically downwardly bent end with an opening. The screw 15 is guided through these openings from the rear and screwed into the linkage 13. In addition, the sheet-metal element 16 has on either side of its rear region, displaced away from the centre to some extent, two strips 17.2, which are bent vertically upwards (strips 17.1, 17.2 in FIG. 3). These two strips 17.2 form a rear stop for the ski boot 100 retained in the ski binding 1. These strips act that the ski boot 100 retained in the ski binding 1 cannot slip rearwards and free itself from the front jaw 5. Correspondingly, the length of the sole plate 4 is set such that the two strips 17.2 are in contact with the heel of the ski boot 100 precisely when the ski boot 100 has been inserted in the ski binding 1. It is only once the length of the sole plate 4 has been set in this way that, in a further step, a front position of the automatic heel unit is set, for downhill action, relative to the rear end of the sole plate 4 and to the heel of the ski boot 100. For this purpose, the automatic heel unit, interacting with the rear base element, has a mechanism which is generally known for downhill-ski bindings and is intended for adjusting an automatic heel unit longitudinally.

As already mentioned, the heel element 14 is mounted on the sheet-metal element 16 and on the linkage 13. Thereby, the heel element 14 is mounted such that it can be displaced in the longitudinal direction of the linkage 13 both in relation to the linkage 13 and in relation to the sheet-metal element 16, although the heel element 14 and the sheet-metal element 16 have arranged between them a helical spring 18, which pushes the heel element 14 forwards, up to a stop, in relation to the sheet-metal element 16. It is thus possible for the heel element 14 to be pushed some way rearwards in relation to the sheet-metal element 16, and also in relation to the linkage 13, counter to the spring force applied by the helical spring 18. If the heel element 14 is pushed rearwards in this way, and is moved rearwards, then a connecting bar 19, which connects the two retaining elements 8.1 to one another in the lower region of the retaining elements 8.1, is pushed rearwards against the upwardly directed strips 17.2 of the sheet-metal element 16. As a result, the rearward movement of the connecting bar 19 is stopped by the strips 17.2 and the lower regions of the two retaining elements 8.1 are pivoted forwards relative to the axis 20, by which the retaining elements 8.1 are mounted on the heel element 14. The upper regions of the two retaining elements 8.1 are thus pivoted rearwards and the two retaining elements 8.1 free the heel region of the ski boot 100. If, then, the heel element 14 has been moved rearwards in such a way and is freed, then it is moved forwards again in relation to the linkage 13 and the sheet-metal element 16 by the helical spring 18. As a result, the axis 20 is also moved forwards relative to the upwardly directed strips 17.2 of the sheet-metal element 16, and the bar and the retaining elements 8.1 can be pivoted back. This pivoting back movement takes place automatically, since the two retaining elements 8.1 are subjected, by a leg spring (not shown) arranged around the axis 20, to a torque which pushes the upper regions of the retaining elements 8.1 forwards and the lower regions of the retaining elements 8.1, with the connecting bar 19, rearwards. Correspondingly, this movement of the axis 20 relative to the upwardly directed strips 17.2 of the sheet-metal element 16 means that the two retaining elements 8.1 can be moved back about the axis 20 and can engage around the heel region of the ski boot 100 again from the rear at the top.

This mechanism for freeing and for gripping the ski-boot heel is used as described herein below for shifting the ski binding 1 from the climbing position into the downhill position and back, in order that the heel region of the ski boot 100, in the downhill position, is freed from the retaining elements 8.1 and, in the climbing position, is fixed by the retaining elements 8.1.

Figure 5A:
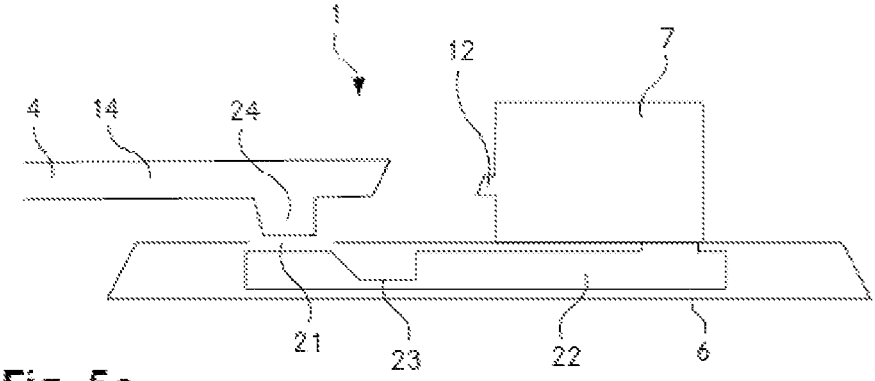
Figure 5B:
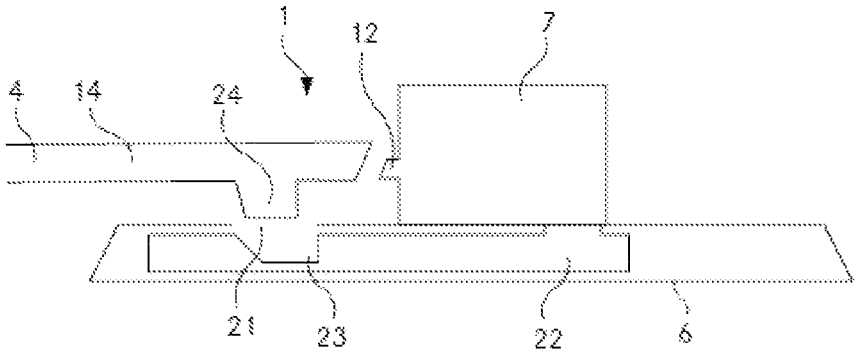
Figure 5C:
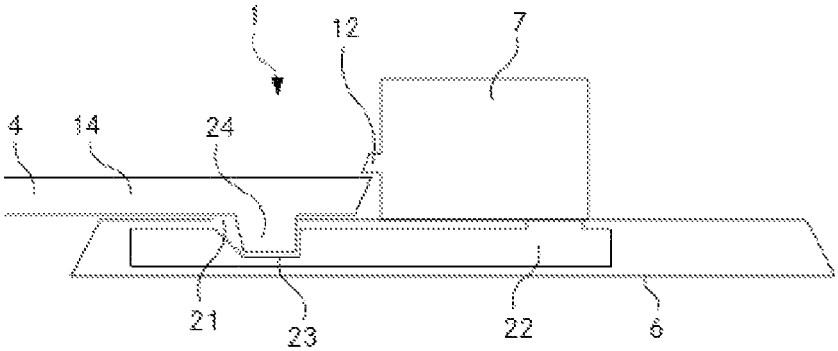

The way in which the heel element 14 is displaced rearwards, counter to the spring force, in order to use the mechanism for freeing the ski-boot heel from the retaining elements during shifting from the climbing position into the downhill position is illustrated in FIGS. 5*a*, 5*b* and 5*c*. These figures each show, for this purpose, a simplified, schematic illustration of the rear base element 6 with the automatic heel unit 7 and the heel element 14. In FIG. 5*a* the ski binding 1 is located in the climbing position, whereas the ski binding 1 in FIG. 5*b* is shown during transfer into the downhill position, and in FIG. 5*c* it is located in the downhill position. All the FIGS. 5*a*, 5*b* and 5*c* illustrate the automatic heel unit 7 schematically by means of a block, in which only the blocking element 12, which is arranged in the front lower region of the automatic heel unit 7, is indicated. FIGS. 5*a*, 5*b* and 5*c* also show the rear base element 6 in a sectional illustration, as a result of which it can be seen that the rear base element 6 has an opening 21 in its front upper region, and that a sliding element 22 is guided in the rear base element 6 such that it can be moved in the longitudinal direction of the ski. This sliding element 22 is in its rear region fastened on the automatic heel unit 7 and, in its front region, has a recess 23 with a flattened, front edge. This sliding element 22 also has, in front of the recess 23, a front end, which is of approximately the same length as the opening 21 in the rear base element 6.

As already mentioned, the ski binding in FIG. 5*a* is shown in the climbing position. Correspondingly, the automatic heel unit 7 and the sliding element 22, which is fastened on the automatic heel unit 7, are located in a rear position. In this position, the front end of the sliding element 22 is placed beneath the opening 21 in the rear base element 6. If, therefore, the sole plate 4 with the heel element 14 is lowered in the direction of the ski, then a stub 24, which is arranged in the rear region at the bottom of the heel element 14, does indeed come into contact with the opening 21 in the rear base element 6, but strikes against the rear end of the sliding element 22, and is thus prevented from any further lowering action.

If, starting from this climbing position, the ski binding 1 is transferred into the downhill position, the automatic heel unit 7 is displaced forwards. This can be done, for example, by an adjusting lever (not shown) mounted on the rear base element 6 and on the automatic heel unit 7 or by a catch system (not shown either). As shown in FIG. 5*b*, the sliding element 22, which is connected to the automatic heel unit 7, is thus also displaced forwards, as a result of which the recess 23 in the sliding element 22 ends up located beneath the opening 21 in the rear base element 6. If, in this position, the sole plate 4 with the heel element 14 is lowered in the direction of the ski, then the stub 24, which is arranged at the bottom of the heel element 14, once again comes into contact with the opening 21 in the rear base element 6. In this case, however, the stub 24 can be guided further downwards into the recess 23. Thereby, the stub 24 strikes against the flattened, front edge of the recess 23 and is pushed rearwards by the oblique surface of the edge.

As a result, the stub 24 and the heel element 14 are moved rearwards, and the heel of the ski boot is freed from the retaining elements by the mechanism explained above. During this movement of the heel element 14 downwards and rearwards, the rear end of the heel element 14 strikes against the blocking element 12. As a result, the blocking element 12 is pushed rearwards, counter to a spring force, into the automatic heel unit 7 and snaps back in the forward direction as soon as the rear end of the heel element 14 is located beneath the blocking element 12 and thus frees the blocking element 12. This means that the heel element 14 is blocked beneath the blocking element 12 and the sole plate 4 is arrested in a state in which it is oriented essentially parallel to the ski, whereas the heel of the ski boot is freed from the retaining elements and is arrested anew in a lowered position by the automatic heel unit 7. The ski binding 1 has thus been transferred into the downhill position.

Figure 6A:
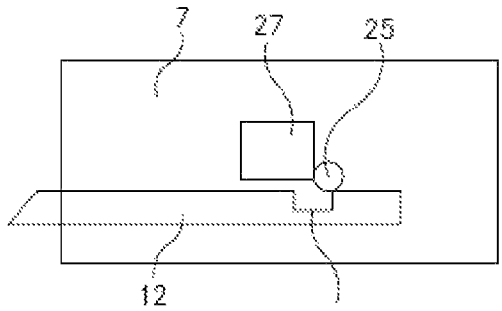
Figure 6B:
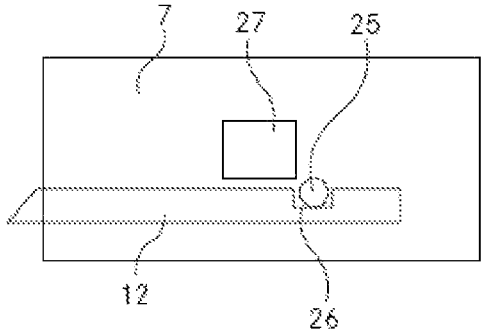
Figure 6C:
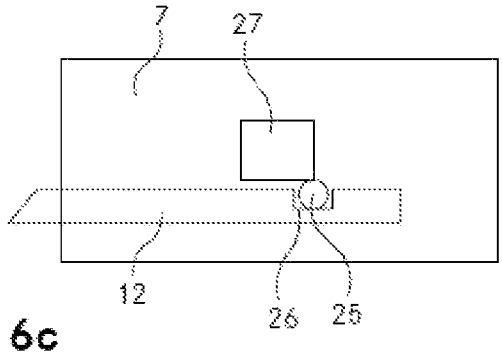

FIGS. 6*a*, 6*b* and 6*c* each show a simplified, schematic illustration of the automatic heel unit 7 with the blocking element 12 in order to illustrate the functioning of the blocking element 12. For this purpose, the automatic heel unit 7 and the blocking element 12 are shown in the climbing position in FIG. 6*a*, whereas in FIG. 6*b* they are shown during the transfer into the downhill position, and in FIG. 6*c* they are shown in the downhill position. As is already the case in FIGS. 1 to 5*c*, the left-hand side of FIGS. 6*a*, 6*b* and 6*c* corresponds to the front of the automatic heel unit 7, whereas the right-hand side of FIGS. 6*a*, 6*b* and 6*c* corresponds to the rear of the automatic heel unit 7. Although the functioning of the blocking element 12 is coupled to the catch or adjusting lever for adjusting the automatic heel unit 7 from the climbing position into the downhill position and back, the catch or adjusting lever, to give a clearer picture, have not been shown in FIGS. 6*a*, 6*b* and 6*c*. All that is shown is a pin 25 which is oriented horizontally in the transverse direction of the ski, is mounted on the catch or adjusting lever and can be moved forwards or rearwards by the catch or adjusting lever.

As can be seen in FIG. 6*a*, the blocking element 12 is located at the front in the climbing position. Therefore, within the automatic heel unit 7, part of an upwardly open recess 26 in the blocking element 12 is located beneath a counterpart 27, which is fixed in the automatic heel unit 7. This means that the pin 25, which is mounted on the catch or adjusting lever for the purpose of adjusting the automatic heel unit 7, cannot be moved into the recess 26 in the blocking element 12. If, therefore, the pin 25 is pushed forwards by the catch or the adjusting lever, the pin 25 strikes against the counterpart 27 and the automatic heel unit 7 is moved forwards from the climbing configuration into the downhill configuration until the automatic heel unit 7 strikes against the aforementioned, front stop on the rear base element and is prevented from moving any further forwards. As soon as the automatic heel unit 7 is positioned in relation to the rear base element in this way, the rear end of the heel element 14, as described in conjunction with FIGS. 5*a*, 5*b* and 5*c*, can strike against the blocking element 12 when the sole plate 4 is lowered downwards. Since both the heel element 14 and the blocking element 12 have bevelled ends and the heel element 14 is moved downwards and rearwards when the sole plate 4 is lowered, the blocking element 12, during this movement, is pushed rearwards, counter to a spring force into the automatic heel unit 7. As shown in FIG. 6*b*, in the automatic heel unit 7, the recess 26 is thus moved behind the counterpart 27 and the axis 25 can drop downwards into the recess 26. As soon as the sole plate with the heel element 14 is located beneath the blocking element 12, the blocking element 12 is moved forwards by a spring (not shown here) and arrests the sole plate 4 in a state in which it is oriented essentially parallel to the ski. In this case, together with the blocking element 12, the recess 26, with the pin 25, is moved some way forwards beneath the counterpart 27.

In order to transfer the ski binding 1 back again from the downhill position into the climbing position, the pin 25 is pulled rearwards by means of the catch or adjusting lever. Since the pin 25 here is initially located in the recess 26 in the blocking element 12, first of all the blocking element 12 is pulled rearwards, as a result of which the heel element 14 and thus the sole plate 4 are freed in the upward direction. If the pin 25 is pulled further rearwards, the automatic heel unit 7, with the sliding element 22 shown in FIGS. 5*a*, 5*b* and 5*c*, is then also moved rearwards. This movement of the automatic heel unit 7 is continued until the automatic heel unit 7 latches, in a rear position, in the climbing configuration and the pin 25 is lifted out of the recess 26 in the blocking element 12 by the movement of the catch or adjusting lever. As a result of the movement of the automatic heel unit 7 and of the sliding element 22 in the rearward direction here, the stub 24 is pushed upwards along the oblique surface of the flattened edge of the recess 23 in the sliding element 22, as a result of which the heel element 14 and the sole plate 4 are released from their arrested state, and as a result of which the heel element 14 can be moved forwards in relation to the linkage 13 and the sheet-metal element by the helical spring 18. As explained in conjunction with FIG. 4, this means that the retaining means 8.1, subjected to the action of a leg spring, can be moved back again and can thus engage around the heel of the ski boot from the top rear and can fix the ski boot correspondingly on the sole plate 4. Therefore, the ski binding 1 can be moved back into the climbing position by actuation of the catch or of the adjusting lever.

Figure 7A:
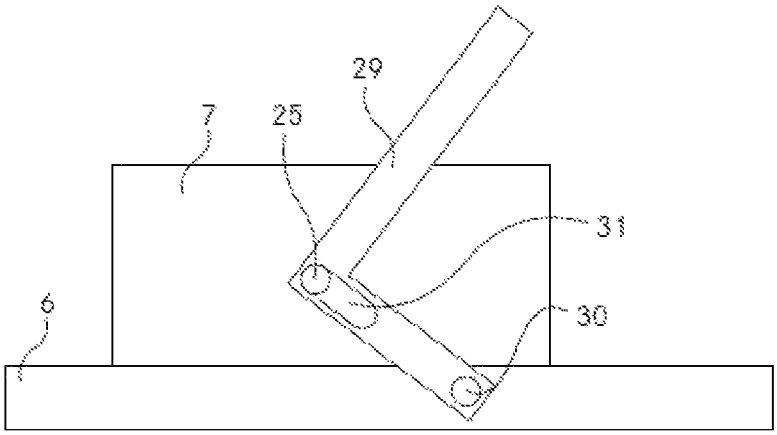
Figure 7B:
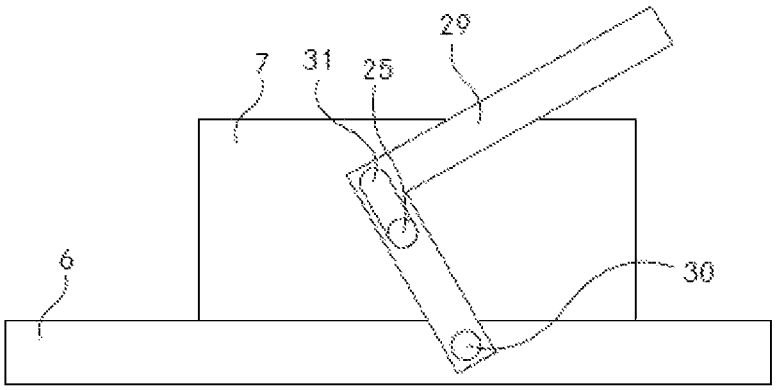
Figure 7C:
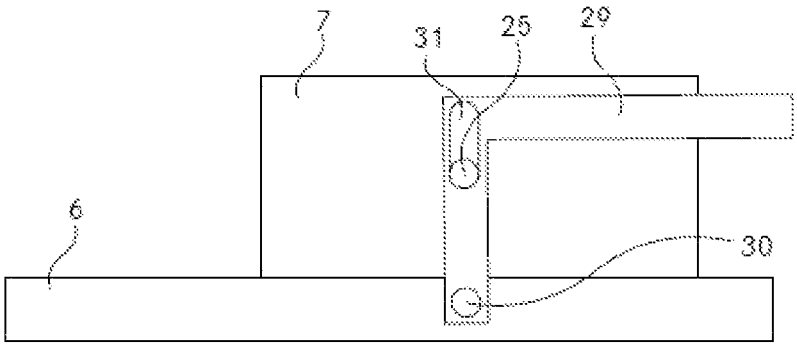

FIGS. 7*a*, 7*b* and 7*c* each show a simplified, schematic illustration of the automatic heel unit 7 mounted on the rear base element 6 and having an adjusting lever for adjusting the automatic heel unit 7 from the downhill configuration into the climbing configuration and back. FIGS. 7*a*, 7*b* and 7*c* serve to illustrate the functioning of the adjusting lever 29. In FIG. 7*a* the automatic heel unit 7 is shown in the downhill configuration, whereas in FIG. 7*b* it is shown during transfer into the climbing configuration, and in FIG. 7*c* it is shown in the climbing configuration. As is already the case in FIGS. 1 to 6*c*, the left-hand side of FIGS. 7*a*, 7*b* and 7*c* corresponds to the front of the automatic heel unit 7, whereas the right-hand side of FIGS. 7*a*, 7*b* and 7*c* corresponds to the rear of the automatic heel unit 7. It should also be noted that this adjusting lever 29 is independent of the opening lever 28, which is described above in conjunction with FIGS. 1 and 2.

The adjusting lever 29 described here is of right-angled elongate form which resembles an "L". A lower end of a lower flank of the adjusting lever 29 here is mounted on the rear base element 6 such that it can be pivoted about a pivot axis 30. Furthermore, in the vicinity of the forwardly oriented right angle in the adjusting lever 29, an elongate opening 31 is arranged in the lower flank of the adjusting lever 29. This elongate opening is oriented parallel to the lower flank of the adjusting lever 29 and serves as a slot guide for the pin 25, which, as already described in conjunction with FIGS. 6*a*, 6*b* and 6*c*, is used for the longitudinal displacement of the automatic heel unit 7.

As can be seen in FIG. 7*a*, the automatic heel unit 7, in the downhill configuration, is located at the front of the rear base element 6. The adjusting lever 29 here has been pivoted forwards to the extent where the pin 25, which on account of the blocking element 12 cannot be moved further downwards (see FIG. 6*c*), strikes against the front, upper end of the elongate opening 31. Correspondingly, the pin 25 and the adjusting lever 29 form the abovedescribed front stop for the automatic heel unit 7, which prevents the automatic heel unit 7 from moving any further forwards.

If the automatic heel unit 7 is to be transferred from the downhill configuration into the climbing configuration, then the obliquely rearwardly and upwardly oriented, upper flank of the adjusting lever 29 is pushed rearwards and downwards. The adjusting lever 29 is thus pivoted rearwards about the pivot axis 30. This movement also causes the elongate opening 31 in the lower flank of the adjusting lever 30 to be moved rearwards, as a result of which the pin 25 is also moved rearwards. This results, in the first instance, in the blocking element 12 in the automatic heel unit 7 being pulled rearwards counter to the abovedescribed spring force. As soon as it is no longer possible for the blocking element 12 to be pulled any further rearwards, the automatic heel unit 7 is moved rearwards together with the pin 25. Since the pivot axis 30 of the adjusting lever 29, however, is located behind and beneath the elongate opening 31, this movement causes the elongate opening to be moved not just rearwards, but also upwards. As a result, the elongate opening 31 is moved upwards relative to the pin 25 until the pin 25 strikes against a lower end of the elongate opening 31 (see FIG. 7*b*), whereupon the pin 25 is lifted upwards by the lower end of the elongate opening 31. As a result, the pin 25, as described in conjunction with FIGS. 6*a*, 6*b* and 6*c*, is lifted upwards out of the recess 26 in the blocking element 12. As soon as the pin 25 has been lifted out of the recess 26, the blocking element 12 is moved forwards again by the spring force. At the same time, the automatic heel unit 7 has reached a latching position, into which it latches. The automatic heel unit 7 has thus been transferred into the climbing configuration.

In order to transfer the automatic heel unit 7 back into the downhill configuration, all that is required is for the adjusting lever 29 to be pivoted back in the forward and upward directions. The pin 25, which is guided in the elongate opening 31, is thus pushed forwards, as a result of which the automatic heel unit 7, as also described in conjunction with FIGS. 6*a*, 6*b* and 6*c*, is moved forwards.

The invention is not only restricted to the ski binding described above. Different modifications and variations can be made to this ski binding. For example, it is possible to use a different blocking element or no blocking element at all. It is also possible for the adjusting lever for adjusting the automatic heel unit from the climbing configuration into the downhill configuration and back to be designed differently to that described above. It is thus possible, for example, for the opening lever and the adjusting lever to be formed by a single lever. It is also possible, for example, for the automatic heel unit to allow not just safety release in the forward direction, but also lateral safety release. However, it is also possible, in principle, for the automatic heel unit to be a fundamentally different design to that described above, as long as it allows safety release in the forward direction. For example, it is also possible for the automatic heel unit not to be displaceable in the longitudinal direction of the ski for shifting between the climbing configuration and the downhill configuration. In this case, the automatic heel unit may be designed such that it can be pivoted back and forth, between the climbing configuration and the downhill configuration, for example, about an axis. It is also possible, however, for the automatic heel unit not to have any special climbing configuration and downhill configuration. In this case, it is also possible, for example, for the pivot axis, about which the sole plate is mounted in a pivotable manner, to be mounted on the front base element such that it can be displaced in the longitudinal direction of the ski on a carriage. This makes it possible for the pivot axis, the sole plate and the front jaw, for climbing action, to be moved into a front position by the carriage, whereas, for downhill action, they can be moved into a rear position. It is possible here for the carriage to be blocked in the corresponding position on the front base element, for example, by a respective catch. In this case, the carriage with the pivot axis has a downhill configuration and a climbing configuration, whereas the automatic heel unit is fixed to the ski.

Irrespective of the design of the automatic heel unit and of the mounting of the pivot axis, it is also possible for the sole plate and the two retaining elements to be designed differently. Therefore, the sole plate can also be designed, for example, such that it is shorter and extends only up to the centre of the ski-boot sole, whereas the retaining elements can be designed, for example, in hook form and can fix the ski boot on the sole plate by being hooked into corresponding counterparts in the ski boot. Instead of the two retaining elements, however, it is also possible to provide, for example, a single retaining element in the form of a hook, of a straightforward clip or designed as an individual step-in retaining element. In such an embodiment with an individual retaining element, it is also possible for the retaining element to be arranged, on the sole plate, for example in the centre of the ski. It is possible here for the retaining element, for example in the downhill position, to have the automatic heel unit engaging around it on either side, and therefore the automatic heel unit interacts with the heel region of the ski boot on either side of the retaining element.

It is also possible, irrespective of these possible variations, for the ski brake, rather than being arranged on the sole plate, to be arranged on the rear base element or on the automatic heel unit. In this case, however, the ski brake, in the climbing position, should be blocked in a deactivated state by the automatic heel unit, in order that the sole plate, when the skier is walking, can be lifted up away from the ski without the ski brake being activated. For this purpose, it is also possible, for example, for the ski brake, solely in the case of safety release in the forward direction, to be activated by a mechanism of the automatic heel unit.

It is also possible, irrespective of these variants, for one or more climbing aids to be provided. These climbing aids may be designed, for example, in the form of a pivoting lever which can be pivoted, if required, beneath the sole plate and supports the sole plate at an appropriate distance from the ski and prevents the same from being lowered any further in the direction of the ski.

Although the ski binding 1 described above can be used as a ski-tour binding, or even as a freeride binding, it is also possible for the ski binding to be of more solid configuration and thus for the invention to be realized clearly in a freeride binding. Equally, however, it is also possible for the invention to be less solid and thus to be realized in a more lightweight state in the form of a conventional ski-tour binding. However, it is also possible to realize the invention for a cross-country binding or Telemark binding in which a downhill position, in which the ski-boot heel is arrested in a lowered position on the ski, is desired in addition.

To summarize, the invention provides a ski binding which allows high settings for safety release and, at the same time, requires only a small amount of force to be exerted by the skier.

The invention claimed is:

1. Ski binding for mounting on an upper side of a ski, comprising a sole element, a front retaining device, for retaining a ski boot in a toe region of the ski boot, and an automatic heel unit, for retaining the ski boot in a heel region of the ski boot, wherein the sole element is mounted such that it can be pivoted about a pivot axis, which is arranged in the front region of the sole element and is oriented essentially horizontally in the transverse direction of the ski, wherein the automatic heel unit allows safety release in the forward direction, and wherein a) the ski binding has a downhill position, in which the sole element is oriented essentially parallel to the ski, b) and the ski binding has a climbing position, in which the sole element can be pivoted about the pivot axis, characterized in that the automatic heel unit, both in the downhill position of the ski binding and in the climbing position of the ski binding, is arranged on the ski, wherein the heel region of a ski boot retained in the ski binding, a) in the downhill position of the ski binding, can be arrested in a lowered position by the automatic heel unit and, b) in the climbing position of the ski binding, can be freed by the automatic heel unit, as a result of which the ski boot, in the climbing position of the ski binding, can be pivoted about the pivot axis together with the sole element.

2. Ski binding according to claim 1, characterized by a blocking element, by means of which, in the downhill position, the sole element is oriented essentially parallel to the ski and from which the sole element, in the climbing position, can be freed.

3. Ski binding according to claim 2, characterized in that, in the downhill position, in the event of safety release, the sole element can be retained by the blocking element in a state in which it is oriented essentially parallel to the ski.

4. Ski binding according to claim 3, characterized in that the automatic heel unit forms the blocking element.

5. Ski binding according to claim 3, characterized in that the sole element has arranged on it at least one retaining element, by means of which the ski boot retained in the ski binding, in the climbing position, can be fixed on the sole element.

6. Ski binding according to claim 2, characterized in that the automatic heel unit forms the blocking element.

7. Ski binding according to claim 6, characterized in that the sole element has arranged on it at least one retaining element, by means of which the ski boot retained in the ski binding, in the climbing position, can be fixed on the sole element.

8. Ski binding according to claim 2, characterized in that the sole element has arranged on it at least one retaining element, by means of which the ski boot retained in the ski binding, in the climbing position, can be fixed on the sole element.

9. Ski binding according to claim 2, characterized in that the automatic heel unit has a downhill configuration and a climbing configuration and, in the downhill position, is located in the downhill configuration and, in the climbing position, is located in the climbing configuration, wherein the heel region of the ski boot retained in the ski binding a) can be arrested in a lowered position by the automatic heel unit in the downhill configuration and b) can be freed by the automatic heel unit in the climbing configuration, as a result of which the ski boot, in the climbing position of the ski binding, can be pivoted about the pivot axis together with the sole element.

10. Ski binding according to claim 1, characterized in that the sole element has arranged on it at least one retaining element, by means of which the ski boot retained in the ski binding, in the climbing position, can be fixed on the sole element.

11. Ski binding according to claim 10, characterized in that the ski boot retained in the ski binding, in the downhill position, can be freed by the at least one retaining element.

12. Ski binding according to claim 1, characterized in that the automatic heel unit has a downhill configuration and a climbing configuration and, in the downhill position, is located in the downhill configuration and, in the climbing position, is located in the climbing configuration, wherein the heel region of the ski boot retained in the ski binding a) can be arrested in a lowered position by the automatic heel unit in the downhill configuration and b) can be freed by the automatic heel unit in the climbing configuration, as a result of which the ski boot, in the climbing position of the ski binding, can be pivoted about the pivot axis together with the sole element.

13. Ski binding according to claim 12, characterized in that the automatic heel unit is mounted in a moveable manner on a base element, which is fixed to the ski, and can be moved in relation to the base element into the downhill configuration and into the climbing configuration.

14. Ski binding according to claim 13, characterized in that the automatic heel unit is mounted on the base element such that it can be displaced in the longitudinal direction of the ski, and it is located in a front position in the downhill configuration and in a rear position in the climbing configuration.

15. Ski binding according to claim 13, characterized in that the automatic heel unit is mounted on the base element such that it can be pivoted about an axis, and is located in a first position in the downhill configuration and in a second position in the climbing configuration.

16. Ski binding according to claim 1, characterized in that the front retaining device can be moved in the longitudinal direction of the ski, and is located at the rear in the downhill position and at the front in the climbing position.

17. Ski binding according to claim 1, characterized in that the pivot axis, about which the sole element can be pivoted, can be moved in the longitudinal direction of the ski, and is located at the rear in the downhill position and at the front in the climbing position.

18. Ski binding according to claim 1, characterized in that the sole element can be moved in the longitudinal direction of the ski, and is located at the rear in the downhill position and at the front in the climbing position.

19. Ski binding according to claim 1, characterized in that the automatic heel unit, in the downhill position, can be moved in relation to the ski along a dynamic path essentially in the longitudinal direction of the ski.

20. Ski binding according to claim 19, characterized in that the automatic heel unit, in the downhill position, is subjected to a forwardly directed force by an elastic element.

* * * * *